US007730565B1

(12) United States Patent
Masson

(10) Patent No.: US 7,730,565 B1
(45) Date of Patent: Jun. 8, 2010

(54) ANACONDA FOR A MULTI-PURPOSE GURNEY

(76) Inventor: Marcos V. Masson, 3834 University Blvd., Houston, TX (US) 77005

( * ) Notice: Subject to any disclaimer, the term of this patent is extended or adjusted under 35 U.S.C. 154(b) by 0 days.

(21) Appl. No.: 12/486,311

(22) Filed: Jun. 17, 2009

(51) Int. Cl.
*A61G 1/04* (2006.01)

(52) U.S. Cl. ..... 5/646; 5/648; 5/658; 5/503.1

(58) Field of Classification Search ..... 5/646, 5/648, 503.1, 658; 128/845
See application file for complete search history.

(56) References Cited

U.S. PATENT DOCUMENTS

| | | | | |
|---|---|---|---|---|
| 401,681 | A | 4/1889 | Brown | |
| 0,503,969 | A | 8/1893 | Huddleston | |
| 2,101,290 | A | 12/1937 | Pierson | |
| 2,377,649 | A | 6/1945 | Quinney | |
| 2,510,198 | A * | 6/1950 | Tesmer | 248/229.25 |
| 2,609,862 | A | 9/1952 | Pratt | |
| 3,168,274 | A * | 2/1965 | Street | 248/176.3 |
| 3,393,004 | A | 7/1968 | Williams | |
| 3,579,671 | A | 5/1971 | Koetter | |
| 3,739,406 | A | 6/1973 | Koetter | |
| 4,084,274 | A | 4/1978 | Willis et al. | |
| 4,579,324 | A | 4/1986 | McConnell | |
| 4,658,450 | A | 4/1987 | Thompson | |
| 4,702,465 | A | 10/1987 | McConnell | |
| 4,730,609 | A | 3/1988 | McConnell | |
| 4,939,801 | A | 7/1990 | Schaal et al. | |
| 5,111,541 | A | 5/1992 | Wagner | |
| 5,275,176 | A | 1/1994 | Chandler | |
| 5,355,539 | A * | 10/1994 | Boettger | 5/503.1 |
| 5,400,772 | A * | 3/1995 | LeVahn et al. | 600/230 |
| 5,419,756 | A | 5/1995 | McConnell | |
| 5,662,300 | A | 9/1997 | Micheldson | |
| 5,699,988 | A * | 12/1997 | Boettger et al. | 248/122.1 |
| 5,775,334 | A | 7/1998 | Lamb et al. | |
| 5,899,425 | A * | 5/1999 | Corey Jr. et al. | 248/276.1 |
| 5,926,876 | A | 7/1999 | Haigh et al. | |
| 5,957,135 | A | 9/1999 | Molina | |
| 6,186,900 | B1 | 2/2001 | Rathnakar | |
| 6,289,537 | B1 | 9/2001 | Hopper et al. | |
| 6,564,406 | B2 | 5/2003 | VanSteenburg et al. | |
| 6,698,044 | B2 * | 3/2004 | Greenfield et al. | 5/624 |
| 6,804,846 | B2 | 10/2004 | Schuerch | |
| 6,880,432 | B2 | 4/2005 | Hsieh | |
| 7,395,563 | B2 * | 7/2008 | Whitmore et al. | 5/601 |
| 2009/0072107 | A1 * | 3/2009 | Wilson et al. | 248/279.1 |

* cited by examiner

*Primary Examiner*—Michael Trettel
(74) *Attorney, Agent, or Firm*—Egbert Law Offices PLLC

(57) ABSTRACT

An apparatus has segments connected end-to-end so as to form a flexible tube, a base connected to a first segment of the segments, a clamp connected to the base for mounting the base, and a tensioning mechanism for tensioning the segments. A scope adapter can be connected to a last segment of the plurality of segments. An extremity adapter can be connected to a last segment of the plurality of segments. The clamp can mount the base to a mayo stand of a multi-purpose gurney. The clamp can also mount the base to a rail of a multi-purpose gurney.

13 Claims, 5 Drawing Sheets

ANACONDA FOR A MULTI-PURPOSE GURNEY

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to accessories for multi-purpose gurneys. Particularly, the present invention relates to accessories used during surgery. More particularly, the present invention relates to holders of accessories. More particularly, the present invention relates holders for a patient's extremities.

2. Description of Related Art Including Information Disclosed Under 37 CFR 1.97 and 37 CFR 1.98

Gurneys are often used in the hospital environment for patient support and transport. In particular, when a patient is taken to the operating room, the patient is placed upon a gurney and wheeled into the operating room. Once in the operating room, the patient is transferred from the gurney onto the surgical table so that the patient is in a proper position for surgery. The gurney is then removed from the operating room, or placed elsewhere, during the surgical procedure. Subsequent to surgery, the gurney is then returned to the operating room, the patient is placed upon the gurney, and then the patient is wheeled to other locations. The patient is also transferred from the gurney to a wheelchair when the patient leaves the hospital.

Unfortunately, the continual transfer of the patient from the gurney to the surgical table and from the gurney to the wheelchair, is inconvenient, time-consuming, tiresome and potentially injurious. Nurses, and other hospital personnel, often experience back pain, and other assorted injuries, during the transfer of the patient. Often, the patient must be physically lifted from the surgical table and placed upon the gurney and vice-versa. In other circumstances, the improper movement of the patient can adversely affect the surgical procedure or the results achieved from the surgery. As such, a need has developed whereby the gurney is actually used as the operating table and the wheelchair.

Various patents have issued relating to gurneys and operating tables. For example, U.S. Pat. No. 4,939,801, issued on Jun. 10, 1990 to Schuerch et al., teaches a patient transporting and turning gurney for receiving and lifting a patient from a hospital bed, for transporting and depositing the patient onto the hospital operating table, and for lifting and turning a patient for surgery. The gurney has a U-shaped base. This base is of sufficiently small dimension to fit under a hospital bed and of sufficiently large dimension to straddle the sides of the conventional operating table pedestal. The gurney further includes an overlying stretcher support for supporting a rotatable stretcher frame. A longitudinally extending rotating stretcher frame is mounted for rotation about its longitudinal axis on the stretcher support. There is provided a lifting device for moving the stretcher support upwardly and downwardly relative to the base.

U.S. Pat. No. 5,111,541, issued on May 12, 1992 to K. E. Wagner, describes a non-metallic gurney for patient transport. This gurney is formed of materials that are non-metallic, non-magnetic and of low electrical conductivity. This gurney is particularly used for modern non-invasive body scanning equipment.

U.S. Pat. No. 5,275,176, issued on Jan. 4, 1994 to Chandler, describes a surgical operating table particularly adapted for shoulder arthroscopy. The table includes a central seat support, a leg support, and a back support modified to include detachable modular shoulder cut-out to gain access to the posterior aspect of the shoulder. The leg support and back support are hingedly connected to the seat support for positioning the patient in a seating posture by operating mechanical crank arms. The patient is first supported in a supine position, anaesthetized, secured to the table, and the table is thereafter configured to a sitting position. One of the modular shoulder cut-outs is then removed to provide access to the shoulder on which arthroscopy is to be performed.

U.S. Pat. No. 3,739,406, issued on Jun. 19, 1973 to Koetter, discloses an adjustable bed particularly for use in hospitals and nursing homes for which a chassis is provided with at least one telescopically expandable pan, a bed frame tiltable relative to the chassis, at least one lifting assembly being disposed on the chassis, and at least one foot for each extendable part of the span. The bed frame has a middle portion and two end portions hinged to the middle portion. At least one lifting assembly is disposed at each end of the middle portion of the bed frame for adjusting the bed frame to various elevated and inclined positions.

U.S. Pat. No. 6,804,846, issued on Oct. 19, 2004 to Schuerch, discloses an adjustable position shoulder arthroscopy chair for surgical operating tables consisting of aback supporting platform pivotally attachable to the end of the table and an externally powered position actuator mounted at the base of the platform nearest the table and pivotally mounted to the platform at a location spaced apart from the base. The actuator is extendable and retractable and may be powered either electrically, hydraulically, or by compressed air. The extension and retraction of the actuator is controlled by a suitable device within the actuator or remote from it.

U.S. Pat. No. 5,926,876, issued on Jul. 27, 1999 to Haigh et al., discloses a device for adapting a surgical operating table such that the upper torso of the patient can be raised in order to place the patient in a seated position, the device further providing the means of exposing or supporting a side of the patient's upper torso and limbs. The device contains a continuously adjustable positioning mechanism, and corresponding actuator for the mechanism, in a way that a user can rapidly and conveniently put a patient in the desired position, from a supine posture to a fully seated position. Additionally, the device does not render the surgical table permanently modified, as the process of modification is reversible by means of a simple attachment mechanism. The device uses a back support section hingedly connected to a base frame, this base frame providing the attachment support to the surgical table. Side support panels are either moved out of the way on the patient's operative side, or left in place to provide support to the unaffected side. Two embodiments are described that differ solely in the way the back support surface is implemented.

U.S. Pat. No. 4,658,450, issued on Apr. 21, 1987 to Thompson, discloses a multi-position bed for use in hospitals. The bed has a base frame supported on casters and having a pair of pivoted angled lifting arms. One lifting arm is pivoted in turn to an interlink pivoted to a pivot bracket. Another lifting arm is pivoted directly to a second pivot. Pivot brackets act as the pivot supports for the center section of a mattress platform which also comprises two side sections. The side sections are not hinged directly to the center section but simply have inter-engaging features in the form of side frame registers. When the bed is used as a turning bed the inter-engaging features disengage. The side sections are carried by pairs of links which join the pivot brackets to the side sections at points underneath the side sections. These side sections are also connected by side frame pivot arms to an end pivot frame at each end of the bed. The pivot frame is rigidly connected to the center bed section. The movement of the bottom links is restricted in a downward direction by bottom link stops. The links may be disconnected and the side sections connected rigidly to the center section so that the mattress platform can be caused to tilt bodily in a lateral sense.

U.S. Pat. No. 4,084,274, issued on Apr. 18, 1978 to Willis et al., discloses a turning bed which can be tilted mechanically to turn the occupant from side to side, comprising a tilting assembly pivotally secured to a bed frame of known type. The tilting assembly consists of a mattress frame longitudinally divided into at least three parts: a center section with an outer section pivotally connected adjacent each longitudinal side of the center section. The pivotal connection is such that when the center section is tilted, the outer section adjacent the raised side of the center section is tilted as one with the center section, and the outer section adjacent the other side of the center section pivot relative thereto. The center section is pivotally supportable from the bed frame, and can be tilted by a lever secured at one end to the center section, the other end of the lever being moveable (by suitable means such as a screw-and-nut arrangement) to tilt the center section.

U.S. Pat. No. 3,579,671, issued on May 25, 1971 to Koetter, discloses an adjustable bed that has a chassis, a bed frame disposed on the chassis, two or three hydraulic cylinder piston units disposed at the ends of the bed, an articulated connection between the cylinder and the piston unit and the bed frame so that the bed frame may be moved to various elevated and/or inclined positions.

U.S. Pat. No. 2,609,862, issued on Sep. 9, 1952 to Pratt, discloses a hospital chair with a base, a frame having three section, and a mechanical lifter that adjusts the height of the chair up and down. The sections of the chair fold up and down to change the chair position to a flat position. The height and positions of the sections are adjusted manually.

U.S. Pat. No. 2,377,649, issued on Jun. 5, 1945 to Quinney, discloses a convertible chair that converts from a chair position to a bed position. Various mechanical ratchets and spools accomplish the objective of changing positions of the chair. The chair has a frame with three sections. The ends of the frame have legs for supporting the sections on the floor. The position of the convertible chair is adjusted manually.

U.S. Pat. No. 3,393,004, issued on Jul. 16, 1968 to Williams, discloses a hydraulic lift system for wheeled stretchers. The system has a lift mechanism that permits the direct placement of the patient-supporting in end-wise tilt in either direction from any previous position. The lift mechanism has a hydraulic lift cylinder, a positive-displacement pump connected to the hydraulic lift cylinder, a mechanism for operating pumps in unison, a reservoir connected to the pumps, a relief valve positioned between the hydraulic lift cylinder and the reservoir, and a hand-operated valve in fluid communication with the hydraulic lift cylinder.

U.S. Pat. No. 2,101,290, issued on Dec. 18, 1936 to Pierson, discloses an invalid chair with a frame having four sections and a base with wheels. The position of the sections is manually adjusted to change the position of the chair from a chair position to a bed position. The base of the chair is of a fixed height.

U.S. Pat. No. 503,969, issued on Aug. 29, 1893 to Huddleston, discloses a corpse dressing table with a movable head section. The head section moves upward relative to the rest of the table so as to position the torso of a corpse at an angle relative to the legs. The table can be folded upon itself for storage and transportation.

U.S. patent application Ser. No. 11/139,946, filed on May 31, 2005 by the present inventor, discloses a gurney for use in arthroscopic surgery that has a base and a frame positioned above the base. The frame has a plurality of deck sections pivotally connected together. One of the deck sections is a torso support section and has a plurality of panels connected together. At least one of the panels is separable from the other panels. The height of the frame above the base can be suitably adjusted by the use of first and second rams which are connected to one of the deck sections. The pivotability of the deck sections and the height-adjusting mechanism allow the gurney to assume a variety of positions.

During surgical procedures, the surgeon's instruments are often in a very inconvenient location. In certain circumstances, the surgeon must drape the cords associated with the instruments over the patient or route the chords through inconvenient arrangements. Cord management is a continual problem for the surgeon during any surgical procedure. The improper routing and location of the cords can cause an improper operation of the instrument or restrict the surgeon from his or her desired use of the instrument. As such, a need has developed so as to provide instrument holders for surgeons during arthroscopic surgery.

In the performance of orthopedic surgery and related procedures, it is often necessary to support a patient's extremities, including one or more limbs, in a fixed position during the procedure, and also to vary the position from time to time. Often times, it is desirable to maintain such a limb, for example, in a fixed position during the surgical procedure so as to keep the procedure area as clear as possible and avoid the limb interference. In some cases, operating room personnel manually support the particular extremity. For example, the assistant may have to stand on a platform in order to manually hold the correct angle while the surgeon carries out the operation. Such use of operating room personnel to manually support a patient's extremities during a surgical procedure is undesirable because the assistant becomes tired over time and finds it necessary to change positions at a critical or otherwise inconvenient times. This may lead, for example, to actual trauma to the structures of the body. Furthermore, the assistant is unable to observe crucial aspects of the operation itself. Moreover, in addition to possibly interfering with the light available to the surgeon, the height of the assistant may increase the chances of contamination of the operating field. Thus, there is a need for a holder of a patient's extremities.

Various patents have issued and patent applications have been filed relating to holders for accessories and extremities. For example, U.S. patent application Ser. No. 12/034,459, filed on Feb. 20, 2008 by the present inventor, discloses an ambulatory surgical gurney that has a base, a frame positioned above the base, and a lifting mechanism positioned between the base and the frame. The frame has sections pivotally connected together. The lifting mechanism has a first ram extending vertically between the base and the frame, a second ram extending vertically between the base and the frame, a lift arm pivotally connected to the frame, and a controller that controls the movement of the first and second rams and the lift arm. The upper end of the first ram and the upper end of the second ram are pivotally connected to the frame. An anaconda is attached to the frame. The anaconda has segments connected end-to-end and a ratchet spool.

U.S. Pat. No. 6,289,537, issued on Sep. 18, 2001 to Hopper et al., describes a patient support having a frame supporting a patient supporting surface as well as a pair of foot rest mechanisms thereon. The pair of foot rest mechanisms are each selectively movable from a stowed position beneath the patient supporting surface to a deployed position. A drop-leaf foot section forms a part of the patient supporting surface. The drop-leaf foot section is movable to a vertically upright position so as to expose a space between the two foot rest mechanisms.

U.S. Pat. No. 4,579,324, issued on Apr. 1, 1986 to B. E. McConnell, describes a positioning apparatus for use in surgical operating procedures. This positioning apparatus includes one or more generally vertically extending support arms which are connected at their lower ends to universal positioner mechanisms. These mechanisms may be adjustably positioned along a support bar suspended from and substantially rigidly connected to the operating table. The positioning mechanisms include a ball-and-socket coupling including a spaced-apart support block having socket portions for forcibly engaging the block under the urging of a plurality of springs. A lever-actuated cam connects to a foot pedal to operably release the biasing force on the support blocks, whereby the position of the support arm connected at one end to the ball may be finely adjusted over a wide range of positions. U.S. Pat. No. 4,702,465 is continuation-in-part of U.S. Pat. No. 4,579,324 disclosing a similar apparatus.

U.S. Pat. No. 4,730,609, issued on Mar. 15, 1988 to B. E. McConnell, describes a surgical drape having limb-securing structures. A boot of conformable impervious material is attached to the surgical drape for receiving the patient's limb. The boot has a tubular sidewall defining a pocket which is joined in registration with the opening of the drape.

U.S. Pat. No. 5,419,756, issued on May 30, 1995 to B. E. McConnell, describes an arm traction device. This arm traction device has a traction bar in combination with a hand wrap, or hand-and-arm wraps, for suspending and orienting a patient's hand and arm in a substantially elevated position during a surgical procedure. The hand wrap is attached about the patient's closed fist and the traction bar is bendable. The traction bar includes hook-and-loop material so that the traction bar may be conformed to the hand and attach itself securely in place to the top and opposing side surfaces of the hand-wrapped fist so that rotational or traction forces may be applied to the hand and arm.

U.S. Pat. No. 5,775,334, issued on Jul. 7, 1998 to Lamb et al., describes a limb positioning apparatus for surgery. This limb positioning apparatus has a structural member with a compartment having an opening thereto. This structural member is supported at a predetermined position relative to the limb and at a certain distance from the limb. A first line is linked or attached to the limb and connected to a constant force spring located within the compartment of the structural member. A second line is attached to the limb and is also connected to a constant force spring lying within the compartment of the structural member. The forces exerted by the first and second constant force springs are applied cumulatively or alternately to provide a pre-determined tension force on the limb of the patient thereby positioning the limp appropriately.

U.S. Pat. No. 5,957,135, issued on Sep. 28, 1999 to J. E. Molina, describes an arm holder for a transillary first rib resection. This apparatus includes a support assembly, such as a sling, for supporting the limb during the surgical procedure, and a mounting assembly slidably coupled to the support assembly by at least one slide rod. The support assembly is vertically positionable relative to the mounting assembly.

U.S. Pat. No. 6,564,406B2, issued on May 20, 2003 to VanSteenburg et al., discloses a surgical table that has an articulated leg section with accessory attachment rails on opposite sides thereof. A shoulder surgery attachment for the surgical table includes a chair back assembly having a base on one end thereof and a cooperating second connector at each of its sides. Each second connector is releasably attachable to its corresponding first connector. A pair of mounting blades are provided on opposite sides of the base. A rail clamp is positionable along the attachment rails to be fastened to each of the attachment rails to provide a first connector at each side of the leg section.

U.S. Pat. No. 5,662,300, issued on Sep. 2, 1997 to Micheldson, discloses a gooseneck instrument holder having an instrument holder tip, a gooseneck, a base and a detachable fiber-optic light cord. The tip, gooseneck, and base are connected by means of a cable which passes through a deflection member in the base. Tension on the cable is adjusted by a detachable handle at the base via a bolt and serves to simultaneously tighten the tip about an instrument, to hold the gooseneck in place, and to hold the base steady so that the holder holds an instrument in place. Very small amounts of turning of the handle is necessary to adequately tighten the holder in place.

U.S. Pat. No. 6,186,900, issued on Feb. 13, 2001 to Rathnakar, discloses a flexible shaft comprising a flexible outer tube containing a shaft core with specially designed links that closely fit within the smooth interior of the outer tube. The links are substantially rectangular and have a construction which limits a flex angle between links. The links may include stop surfaces which limit the flex angle to prevent kinking or to limit longitudinal movement of the links with respect to one another.

U.S. Pat. No. 6,880,432, issued Apr. 19, 2005 to Hsieh, discloses a ratchet socket for fitting onto a screwed member. The ratchet socket is drivable by a tool to wrench the screwed member. The ratchet socket includes a cylindrical main body formed with at least one internal circular hole and at least one through hole formed on the circumference of the main body and communicating with the circular hole, and a ratchet mechanism including a ratchet wheel rotatably disposed in the circular hole, a dog member movably accommodated in the through hole and a resilient hoop fitted around the main body to exert a resilient force onto the outer side of the dog member so as to keep the dog member resiliently engaged with the ratchet wheel.

U.S. Pat. No. 401,681, issued on Apr. 16, 1889 to Brown, discloses a flexible power shaft that has a flexible sleeve made of leather or rubber, a helical wire coil enclosed in the flexible sleeve, and a chain extending in the interior of the helical wire coil. The shaft is made in sections coupled together successively. The two ends of each sections are similar so that the sections can be connected together end to end.

It is an object of the present invention to hold a scope used in arthroscopic surgery.

It is another object of the present invention to hold a patient's extremity during surgery.

It is another object of the present invention to provide hands-free use of any accessory used during surgery.

It is another object of the present invention to provide an apparatus that easily connects to an operating table or multi-purpose gurney.

It is still another object of the present invention to position accessories when a patient is in a beach-chair or lateral-decubitus position.

It is another object of the present invention to position extremities of a patient when the patient is in a beach-chair or lateral-decubitus position.

These and other objects and advantages of the present invention will become apparent from a reading of the attached specification and appended claims.

BRIEF SUMMARY OF THE INVENTION

The present invention is an apparatus comprising a plurality of segments connected end-to-end so as to form a flexible tube, a base connected to a first segment of the plurality of segments, a clamping means connected to the base for mounting the base, and a tensioning means for tensioning the plurality of segments. A scope adapter can be connected to a last segment of the plurality of segments. An extremity adapter can be connected to a last segment of the plurality of segments.

The tensioning means comprises a wire extending through the plurality of segments, and a lever interconnected to the wire. The lever is pivotally connected to the base. Each of the plurality of segments comprises a cylindrical portion having a hollow interior and a top and a bottom, and a rounded member having a hollow interior and a top and a bottom. The bottom of the rounded member is attached to the top of the cylindrical portion. The hollow interiors of the rounded member and the cylindrical portion form a continuous cylindrical channel within the body.

In one embodiment, the clamping means comprises a first jaw affixed to a side of the base, a screw extending through the first jaw, and a second jaw positioned on an end of the screw. The apparatus can include a mayo stand attached to a multi-purpose gurney. The clamping means mounts the base to the mayo stand. The first jaw is positioned adjacent a bottom of the mayo stand. The second jaw is positioned adjacent a top of the mayo stand.

In another embodiment, the clamping means comprises a shaft extending from the base, a jaw affixed to an end of the shaft opposite the base, and a screw extending through the jaw transverse to the shaft. The apparatus can include a rail attached to a multi-purpose gurney. The clamping means mounts the base to the rail. The jaw extends over a top of the rail.

DETAILED DESCRIPTION OF THE INVENTION

Figure 1:
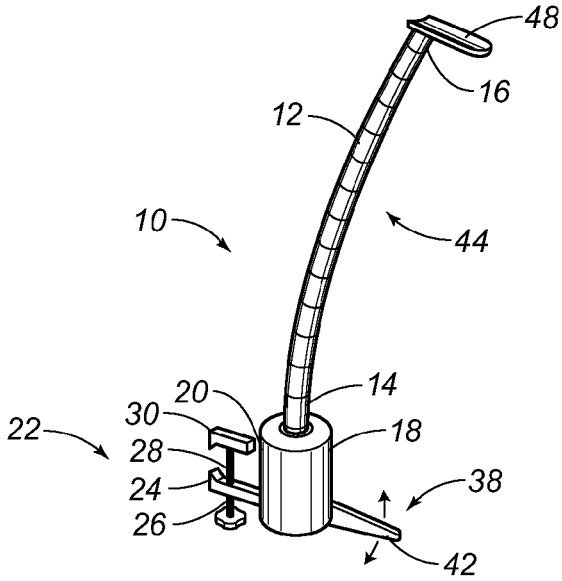
FIG. 1 shows a perspective view of a first preferred embodiment of the apparatus.

Referring to FIG. 1, there is shown a perspective view of a first preferred embodiment of the apparatus 10. The apparatus 10 has segments 12 connected end-to-end so as to form a flexible tube 44. The flexible tube 44 can be bent to form a curve or straightened to form a line because each segment 12 can slightly move with respect to an adjacent segment 12. A base 18 is connected to a first segment 16 of the segments 12. The base 18 shown in FIG. 1 is cylindrical in shape, but the base 18 can be of any shape. The clamping means 22 is attached to a side 20 of the base 18. The clamping means 22 allows the apparatus 10 to be mounted to operating-room equipment, such as a multi-purpose gurney or operating room table. Particularly, a first jaw 24 of the clamping means 22 is attached to the side 20 of the base 18. A screw 26 of the clamping means 22 extends through the first jaw 24. A second jaw 30 of the clamping means 22 is connected to an end 28 of the screw 26 opposite the first jaw 24. The first jaw 24 faces the second jaw 30. The first jaw 24 extends transverse to a longitudinal axis of the base 18. The screw 26 is shown extending through a center of the first jaw 24. The screw 26 is threaded through the first jaw 24 so that turning the screw 26 one direction causes the screw 26 to move upwardly through the first jaw 24 and turning the screw 26 another direction causes the screw 26 to move downwardly through the first jaw 24. The apparatus 10 has a tensioning means 38 that tensions the segments 12 so as to hold them is a desired position. A lever 42 of the tensioning means 38 can be seen extending from the base 18. The tensioning means 38 is described in more detail in FIGS. 5 and 6 below. A scope adapter 48 is attached to the last segment 16 of the segments 12.

When the clamping means 22 mounts the apparatus 10, the rigid connection between the first jaw 24 and the side 20 of the base 18 causes the base 18 of the apparatus 10 to be a stable foundation for the segments 12. The segments 12 can be bent in whatever position is desired, and the segments 12 can be tensioned in the desired position by the tensioning means 38. The segments 12 thus position the scope adapter 48 to a desired location so that a scope used for surgery can be attached thereto.

Figure 2:
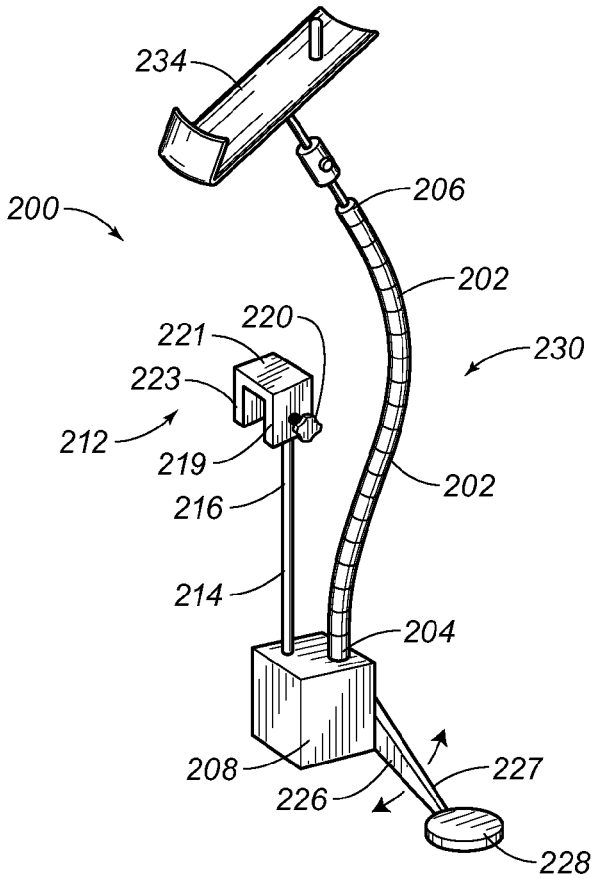
FIG. 2 shows a perspective view of a second preferred embodiment of the apparatus.

Referring to FIG. 2, there is shown a perspective view of a second preferred embodiment of the apparatus 200. The apparatus 200 has segments 202 connected end-to-end so as to form a flexible tube 230. The flexible tube 230 can be bent to form a curve or straightened to form a line because each segment 202 can slightly move with respect to an adjacent segment 202. A base 208 is connected to a first segment 206 of the segments 202. The base 208 shown in FIG. 2 is cubical in shape, but the base 208 can be of any shape. The clamping means 212 is attached to the base 208. The clamping means 212 allows the apparatus 200 to be mounted to operating-room equipment, such as a multi-purpose gurney or operating room table. Particularly, a shaft 214 of the clamping means 212 is attached to a top 210 of the base 208. The shaft 214 extends from the base 208. A jaw 218 is attached to an end 216 of the shaft 214 opposite the base 208. A screw 220 extends through the jaw 218 transverse to the shaft 214. The jaw 218 has a first portion 219 extending upwardly from the shaft 214, a second portion 221 extending transverse from an end of the first portion 219 opposite the shaft 214, and a third portion 223 extending transverse downwardly from an end of the second portion 221 opposite the first portion 219 so that the first, second, and third portions 219, 221, and 223 form a U-shaped jaw 218. The shaft 214 can be rigid or flexible. The jaw 218 allows the apparatus 200 to hang, for example, from a rail of a multi-purpose gurney. The apparatus 200 has a tensioning means 226 that tensions the segments 202 so as to hold them is a desired position. A lever 227 of the tensioning means 226 can be seen extending from the base 208. A foot pedal 228 is attached to the lever 227 for actuation of the tensioning means 227 with a foot. The tensioning means 226 is described in more detail in FIGS. 5 and 6 below. An extremity adapter 234 is attached to the last segment 206 of the segments 202.

Figure 3:
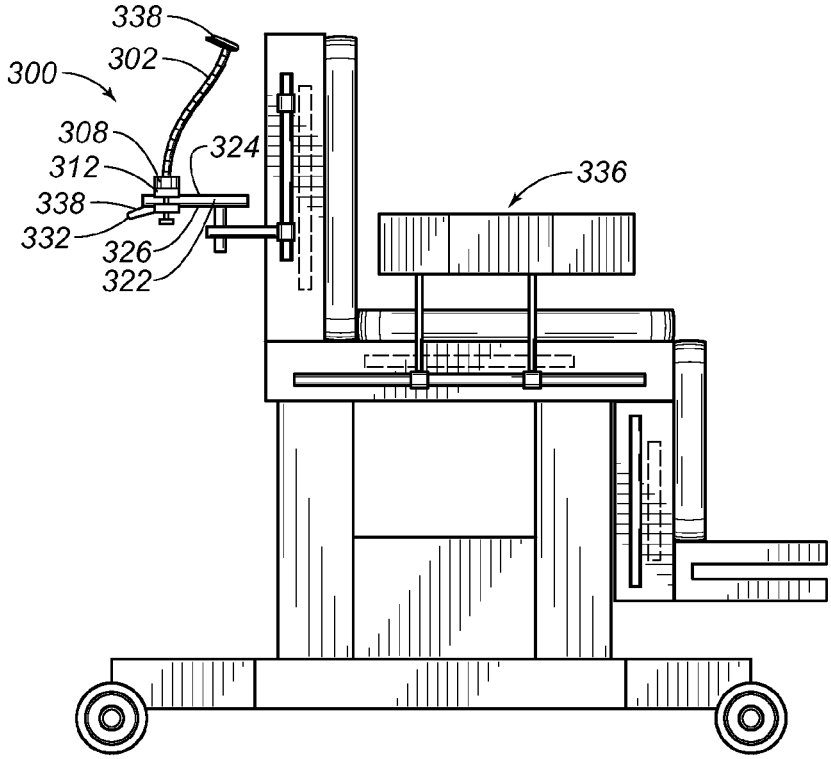
FIG. 3 shows a side elevational view of a third preferred embodiment of the apparatus.

Referring to FIG. 3, there is shown a side elevational view of a third preferred embodiment of the apparatus 300. The apparatus 300 is similar to the apparatus 10 shown in FIG. 1, except that the apparatus 300 has a mayo stand 322. The mayo stand 322 is attached to a multi-purpose gurney 336. The multi-purpose gurney 336 can be a wheel-chair, an operating room table, or a gurney. The first jaw of the clamping means 312 is positioned adjacent a bottom 326 of the mayo stand 322. The second jaw of the clamping means 312 is positioned adjacent a top 324 of the mayo stand 322. The segments 302 are bent forward toward the multi-purpose gurney 336 so that a scope can be placed on the scope adapter 338 next to a patient that is positioned on the multi-purpose gurney 336. The multi-purpose gurney 336 has the ability to position a patient in a beach-chair position and a lateral-decubitus position. The mayo stand 322 of the apparatus 300 is attached to the multi-purpose gurney 336 such that if the multi-purpose gurney 336 changes position or is moved between locations, the mayo stand 322 moves with the multi-purpose gurney 336. Likewise, the base 308 of the apparatus 300 is rigidly attached to the mayo stand 322 via the clamping means 312 such that the base 308 moves with the mayo stand 322. Thus, the apparatus 300 moves with the multi-purpose gurney 336 so that the scope that is attached to scope adapter 338 the apparatus 300 moves with the multi-purpose gurney 336 so as to provide minimal disturbance to the patient positioned on the multi-purpose gurney 336. The tensioning means 332 of the apparatus 300 is in a position where the segments 302 are tensioned. The apparatus 300 shown in FIG. 3 can be used for shoulder arthroscopy because it is positioned on the mayo stand 322 near where the shoulder of a patient would be positioned. The segments 302 are flexible so that a scope attached to the scope adapter 338 can be moved toward and away from a patient positioned on the multi-purpose gurney 336 as needed.

Figure 4:
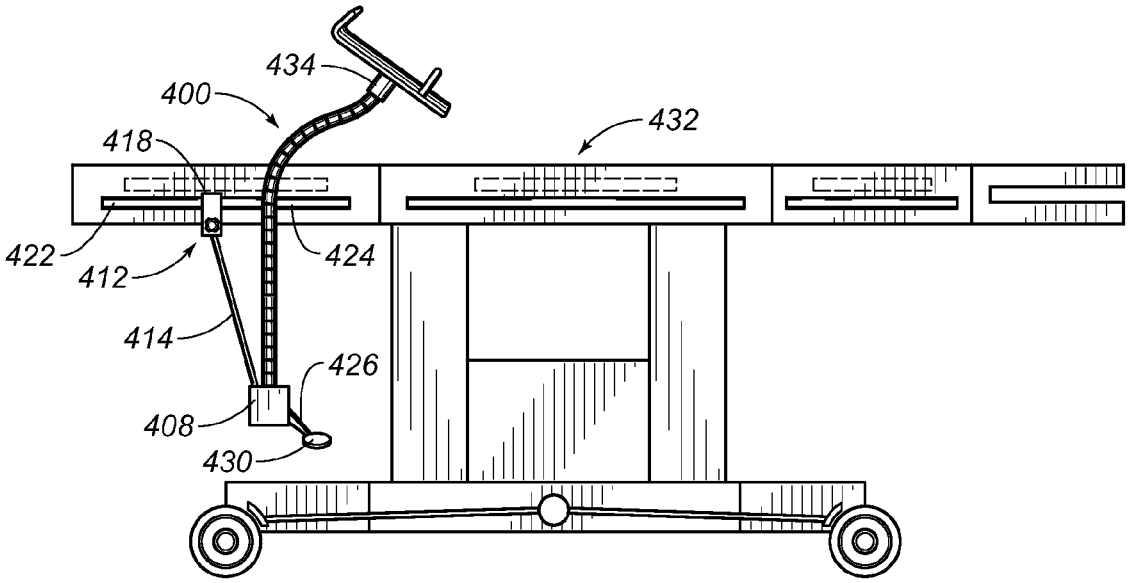
FIG. 4 shows a side elevational view of a fourth preferred embodiment of the apparatus.

Referring to FIG. 4, there is shown a side elevational view of a fourth preferred embodiment of the apparatus 400. The apparatus 400 is similar to the apparatus 200 shown in FIG. 2, except that the apparatus 300 has a rail 422. The rail 422 is attached to a multi-purpose gurney 432. The multi-purpose gurney 432 is shown in an operating room table position, but the multi-purpose gurney 432 can be a wheel-chair, an operating room table, or a gurney. The jaw 418 of the clamping means 412 extends over a top 424 of the rail 422. The shaft 414 allows the lever 430 of the tensioning means 426 of the apparatus 400 to be positioned near the bottom of the multi-purpose gurney 432 so that the lever 430 can be actuated with a foot of operating room personnel.

The segments 402 are bent forward, and an extremity adapter 434 extends above the multi-purpose gurney 432 so that an extremity of a patient positioned on the multi-purpose gurney 336 can be supported. The multi-purpose gurney 432 has the ability to position a patient in a beach-chair position and a lateral-decubitus position. The rail 422 of the apparatus 400 is attached to the multi-purpose gurney 432 such that if the multi-purpose gurney 432 changes position or is moved between locations, the rail 422 moves with the multi-purpose gurney 432. Likewise, the base 408 of the apparatus 400 is rigidly attached to the rail 422 via the clamping means 412 such that the base 408 moves with the rail 422. Thus, the apparatus 400 moves with the multi-purpose gurney 432 so that an extremity of a patient placed on the extremity adapter 434 moves with the multi-purpose gurney 432 so as to provide minimal disturbance to the patient positioned on the multi-purpose gurney 432 and to the extremity of the patient positioned on the apparatus 400. The tensioning means 426 of the apparatus 400 is in a position where the segments 402 are tensioned. The apparatus 400 shown in FIG. 4 can be used for shoulder arthroscopy because it is positioned on the rail 422 near where the shoulder of a patient would be positioned. The segments 402 are flexible so that the extremity adapter 434 can be positioned under a patient's extremity, i.e. arm, as needed.

Figure 5:
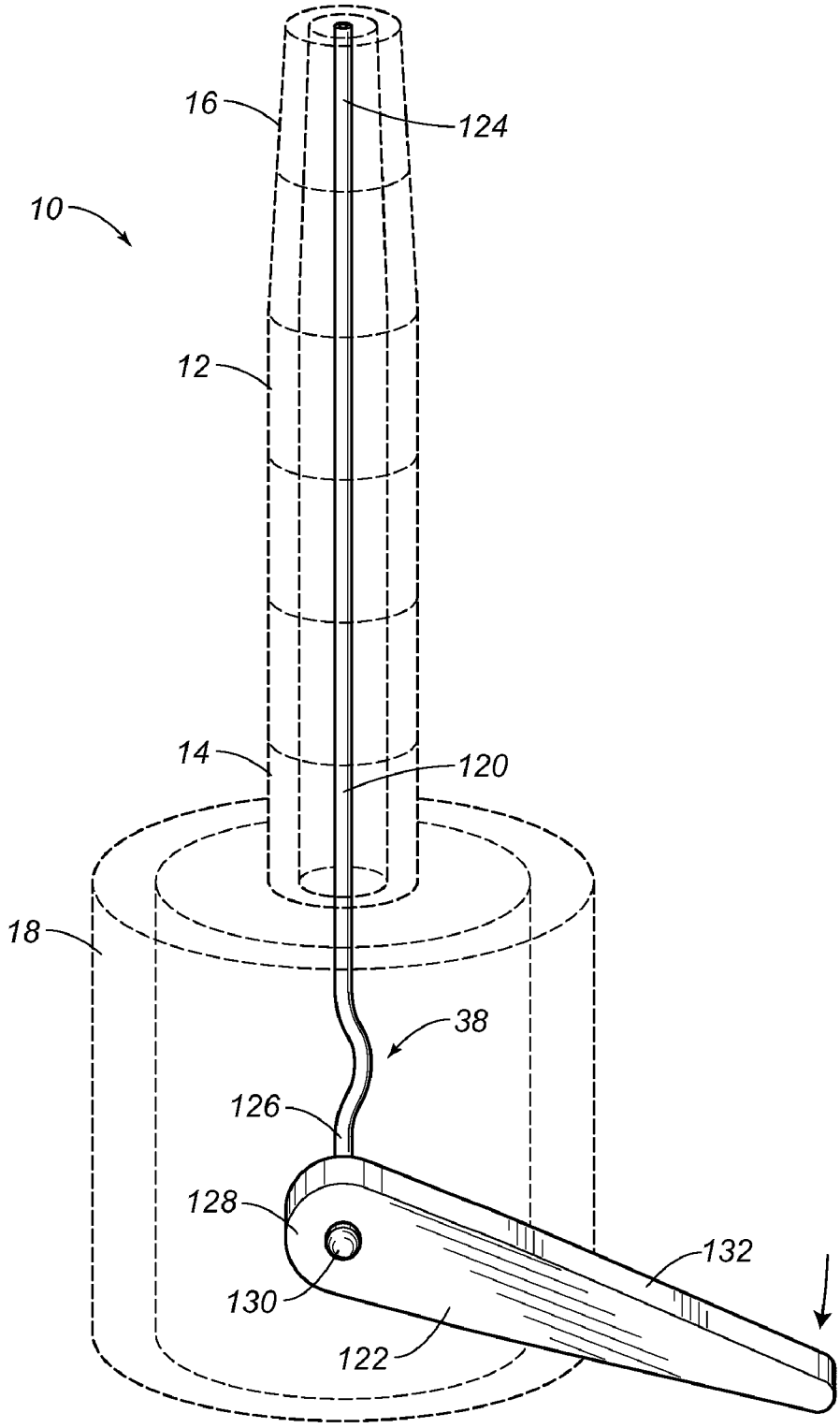
FIG. 5 shows a perspective view of the tensioning means of the apparatus in a first position.

Referring to FIG. 5, there is shown a perspective view of the tensioning means 38 of the first preferred embodiment of the apparatus 10 in a first position. The tensioning means 226 of the second preferred embodiment of apparatus 200, the tensioning means 328 of the third preferred embodiment of apparatus 300, and the tensioning means 426 of the fourth preferred embodiment of apparatus 400 have similar construction to the tensioning means 38 of the first preferred embodiment of apparatus 10. The tensioning means 38 has a wire 120 attached to a lever 122. The wire 120 has an end 124 attached to the last segment 16 of the segments 12. The wire 120 has an opposite end 126 attached to the first segment 14 of the segments 12. The lever 122 has an end 128 attached to the base 18 at pivot point 130. The base 18 has an interior that is hollow so that the wire 120 and lever 122 can interconnect therein. The opposite end 132 of the lever 122 can be actuated between a first position and a second position by a hand of operating room personnel. The lever 122 is shown in FIG. 5 in the first position. The first position allows the segments 12 to move relative to the base 18 because tension on the wire 120 of the tensioning means 38 is released. The wire 120 can be seen with slack in FIG. 5. The wire 120 is interconnected to the end 128 of the lever 122. In FIG. 5, the wire 120 is shown as directly connected to the end 128 of the lever 122, but an suitable mechanism can be placed between the end 126 of the wire 120 and the end 128 of the lever 122 so as to adequately construction the tensioning means for tensioning the wire 120. The segments 12 can be seen in FIG. 5 with hollow interiors. The wire 120 extends within the hollow interiors of the segments 12. The wire can be made of any material suitable for tensioning the segments 12. The arrow in FIG. 5 shows the end 132 of the lever 122 shows that the lever 132 has been pivoted downward relative to the base 18 so as to remove the tension from the wire 120 and the segments 12.

Figure 6:
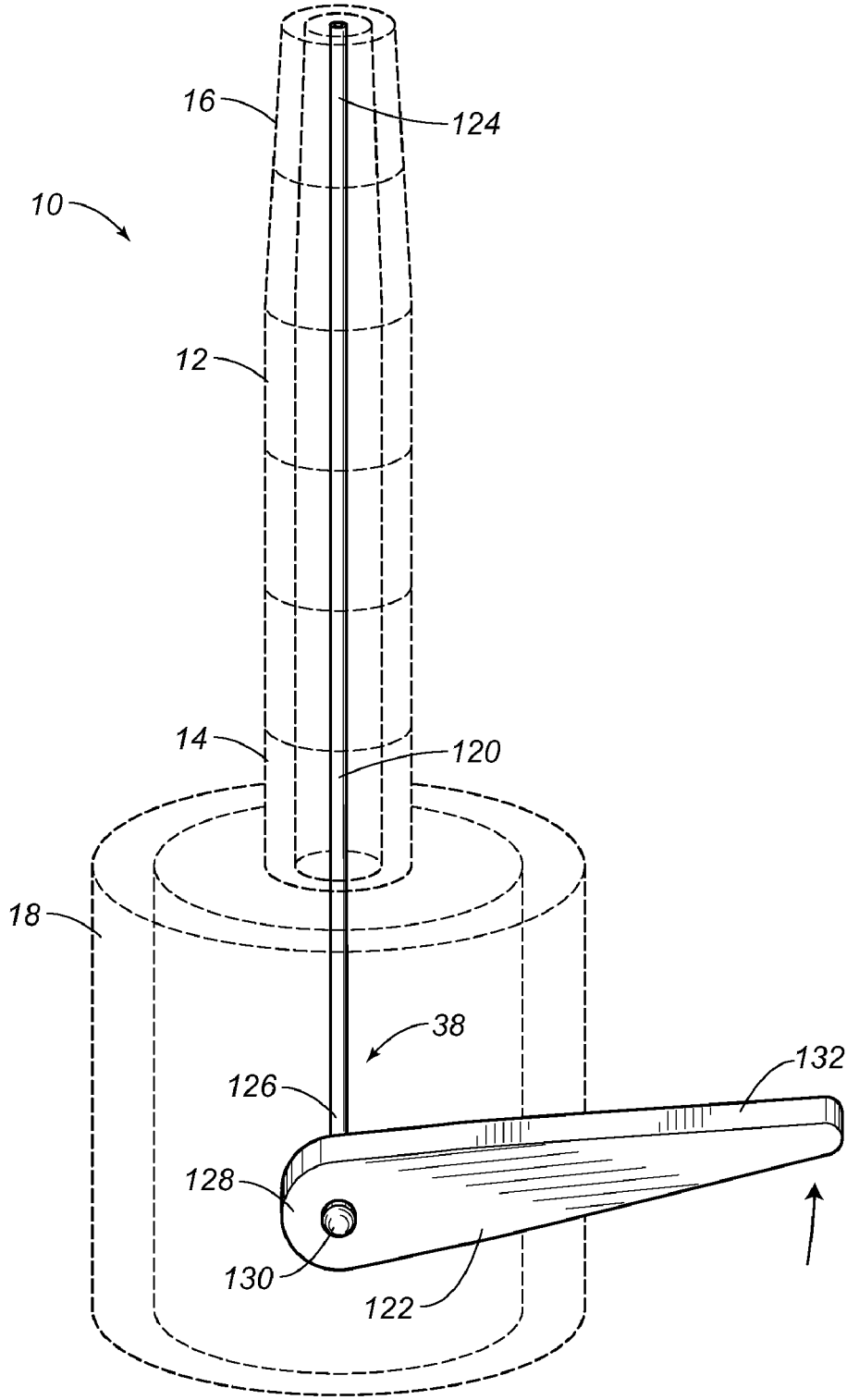
FIG. 6 shows a perspective view of the tensioning means of the apparatus in a second position.

Referring to FIG. 6, there is shown a perspective view of the tensioning means 38 of the first preferred embodiment of the apparatus 10 in a second position. The arrow adjacent the end 132 of the lever 122 shows that the lever 122 has pivoted about pivot point 130 so that the end 132 of the lever 122 moved upwardly relative to the base 18. As the end 128 of the lever 122 rotated about pivot point 130, the end 126 of the wire 120 moved with the end 128 of the lever 122 and tension was applied to the wire 120. The wire 120 thus provided tension to keep the segments 12 in position. The position of the segments 12 shown in FIG. 6 is relatively straight, but the segments 12 can be bent in any direction and tensioned.

Figure 7:
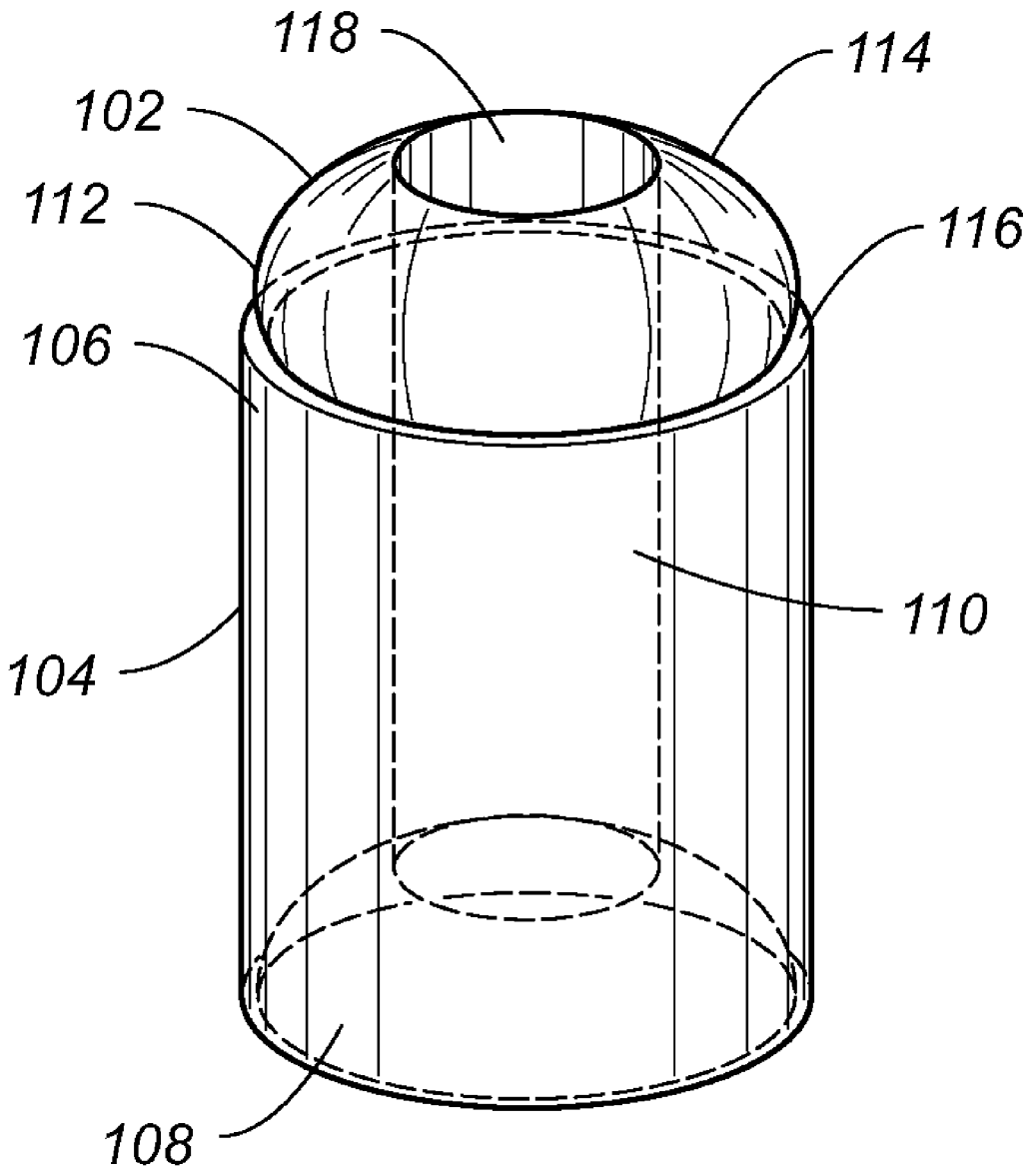
FIG. 7 shows a perspective view of a segment of the apparatus.

Referring to FIG. 7, there is shown a perspective view of a segment 102 of the apparatus. The segment 102 has a cylindrical portion 104 and a rounded member 112. The cylindrical portion 104 has a top 106, a bottom 108, and an interior 110. The rounded member 112 has a top 114, a bottom 116, and an interior 118. The top 106 of the cylindrical portion 104 is adjacent the bottom of the rounded member 112. The interior 110 of the cylindrical portion 104 and the interior of the rounded member 112 are formed so that they create a continuous channel within the segment 102. A tension cable (not shown) extends through this channel so as to be tensionable and fix a position of the segment 102. The bottom 108 of the cylindrical portion 104 is formed so as to accommodate the top 114 of the rounded member 112. In this way, the segment 102 can be connected end-to-end with other segments so as to form the anaconda 98 of the present invention.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a plurality of segments connected end-to-end so as to form a flexible tube, each of said plurality of segments comprising:

a cylindrical portion having a hollow interior and a top and a bottom; and a rounded member having a hollow interior and a top and a bottom, said bottom of said rounded member being attached to said top of said cylindrical portion, said hollow interiors of said rounded member and said cylindrical portion forming a continuous cylindrical channel;

a base connected the bottom of the rounded member of a first segment of said plurality of segments;

a clamping means connected to said base, said clamping means for mounting said base to an exterior surface; and a tensioning means for tensioning said plurality of segments into a desired shape, said tensioning means being connected to said base, said tensioning means comprising:

a line extending through said plurality of segments, and a lever interconnected to said line, said lever pivotally connected to said base, said lever being movable so as to selectively tension said line.

2. The apparatus of claim 1, further comprising:

a scope adapter connected to a last segment of said plurality of segments.

3. The apparatus of claim 1, further comprising:

an extremity adapter connected to a last segment of said plurality of segments.

4. The apparatus of claim 1, said clamping means comprising:

a first jaw affixed to a side of said base;

a screw extending through said first jaw; and a second jaw positioned on an end of said screw.

5. The apparatus of claim 1, said clamping means comprising:

a shaft extending from said base;

a jaw affixed to an end of said shaft opposite said base; and a screw extending through said jaw transverse to said shaft.

6. An apparatus for use with a multi-purpose gurney comprising:

a mayo stand suitable for attachment to the multi-purpose gurney;

a plurality of segments connected end-to-end so as to form a flexible tube;

a base connected to a first segment of said plurality of segments; and a clamping means connected to said mayo stand and to said base, said clamping means for mounting said base to said mayo stand, said clamping means comprising:

a first jaw affixed to a side of said base;

a screw extending through said first jaw; and a second jaw positioned on an end of said screw, said first jaw positioned adjacent a bottom of said mayo stand, said second jaw positioned adjacent a top of said may stand.

7. The apparatus of claim 6, further comprising:

a tensioning means for tensioning said plurality of segments, said tensioning means being connected to said base.

8. The apparatus of claim 7, said tensioning means comprising:

a line extending through said plurality of segments; and a lever interconnected to said line, said lever pivotally connected to said base, said lever being movable so as to selectively tension said line.

9. The apparatus of claim 6, further comprising:

a scope adapter interconnected to a last segment of said plurality of segments.

10. An apparatus comprising:

a multi-purpose gurney;

a rail attached to said multi-purpose gurney;

a plurality of segments connected end-to-end so as to form a flexible tube, each of said plurality of segments comprising:

a cylindrical portion having a hollow interior and a top and a bottom; and a rounded member having a hollow interior and a top and a bottom, said bottom of said rounded member being attached to said top of said cylindrical portion, said hollow interiors of said rounded member and said cylindrical portion forming a continuous cylindrical channel;

a base connected to a first segment of said plurality of segments;

a clamping means connected to said rail and to said base, said clamping means for mounting said base to said rail;

a tensioning means for tensioning said plurality of segments, said tensioning means comprising:

a wire extending through said plurality of segments; and a lever interconnected to said wire, said lever pivotally connected to said base.

11. The apparatus of claim 10, further comprising:

an extremity adapter interconnected to a last segment of said plurality of segments.

12. The apparatus of claim 10, said clamping means comprising:

a shaft extending from said base;

a jaw affixed to an end of said shaft opposite said base; and a screw extending through said jaw transverse to said shaft.

13. The apparatus of claim 12, said jaw extending over a top of said rail.

* * * * *